United States Patent [19]

Valev

[11] Patent Number: 4,860,852

[45] Date of Patent: Aug. 29, 1989

[54] ASSEMBLY FOR MOUNTING AN EXHAUST SYSTEM ON AN EXHAUST GAS SOURCE SOURCE OF AN INTERNAL COMBUSTION ENGINE

[75] Inventor: Assen Valev, Perchtoldsdorf, Austria

[73] Assignee: Steyr-Daimler-Puch AG, Vienna, Austria

[21] Appl. No.: 271,119

[22] Filed: Nov. 14, 1988

[30] Foreign Application Priority Data

Nov. 24, 1987 [AT] Austria ..... 3086/87

[51] Int. Cl.[4] ..... F01N 7/10

[52] U.S. Cl. ..... 181/240; 181/207; 181/243

[58] Field of Search ..... 181/204, 207, 208, 240, 181/243

[56] References Cited

U.S. PATENT DOCUMENTS

| | | | |
|---|---|---|---|
| 2,160,808 | 6/1939 | Bradley | 181/243 X |
| 4,280,588 | 7/1981 | Veldhuizen | 181/240 |
| 4,428,338 | 1/1984 | Skatsche et al. | 181/204 X |

FOREIGN PATENT DOCUMENTS 3321382 2/1984 Fed. Rep. of Germany .

*Primary Examiner*—B. R. Fuller

*Attorney, Agent, or Firm*—Marmorek, Guttman & Rubenstein

[57] ABSTRACT

An assembly for mounting an exhaust system and for connecting inlet means of said exhaust system to exhaust gas outlet means of an exhaust gas source structure of an internal combustion engine comprises a holder for carrying the exhaust system, metal bellows means fixed to the holder and secured to said exhaust gas source structure and connecting said exhaust gas outlet means to said inlet means, and a plurality of axial vibration dampers. In order to keep the deformations of the metal bellows within permissible limits and permit large forces to be taken up, six axial vibration dampers are provided, which are arranged around one or more metal bellows, only three of said vibration dampers have axes disposed in a plane, only two of said three axes are parallel to each other and the axes of the three other dampers intersect said plane and are parallel to each other or constitute a tripod having an apex spaced from said plane.

10 Claims, 2 Drawing Sheets

ASSEMBLY FOR MOUNTING AN EXHAUST SYSTEM ON AN EXHAUST GAS SOURCE SOURCE OF AN INTERNAL COMBUSTION ENGINE

BACKGROUND OF THE INVENTION

1. Field of the Invention

This invention relates to an assembly for mounting an exhaust system and for connecting inlet means of said exhaust system to exhaust gas outlet means of an exhaust gas source structure of an internal combustion engine. Said assembly comprises a holder for carrying the exhaust system, metal bellows means fixed to the holder and secured to said exhaust gas source structure and connecting said exhaust gas outlet means to said inlet means, and a plurality of axial vibration dampers, which have axes lying in one plane and preferably consist of steel wire mesh and are connected between said holder and said exhaust gas source structure, which may consist of a cylinder head or exhaust gas manifold means.

2. Description of the Prior Art

An assembly for mounting an exhaust system of the type described hereinbefore is known from Published German Application No. 33 21 382.

Another assembly which has been used in practice comprises a plate, which is secured to the exhaust manifold means and carries the holder, which is connected to said plate by two axial vibration dampers consisting of steel wire mesh. Two exhaust pipes are welded to the holder and are connected to the plate by respective metal bellows, which are connected to the holder. In that design, the transmission of sound from the exhaust gas manifold means to the exhaust pipes is attenuated and the axial vibration dampers serve only to limit the deformation of the metal bellows and do not constitute a sound-transmitting structure.

But if the exhaust system comprise an exhaust gas turbine, which must also be carried by the holder, such turbines will exert relatively large forces during the operation of the motor vehicle in which the exhaust plant is installed or during the operation of the engine and when such turbine is mounted on the holder in known manner such forces will result in excessively large deformations of the metal bellows so that the bellows would prematurely be destroyed.

SUMMARY OF THE INVENTION

It is an object of the invention to eliminate said disadvantages and so to improve an assembly of the kind which has been described hereinbefore that the transmission of structure-borne sound will effectively be attenuated and damage to the metal bellows will be avoided even when strong dynamic forces are being exerted.

That object is accomplished in accordance with the invention in that six axial vibration dampers are provided, which are arranged around one or more metal belows, only three of said vibration dampers have axes disposed in a plane, only two of said three axes are parallel to each other and the axes of the three other dampers intersect said plane and are parallel to each other or constitute a tripod having an apex spaced from said plane. Owing to that arrangement of the axial vibration dampers, all dampers will be loaded only by axial forces, regardless of the nature of the stress, i.e., they will be loaded by forces which will result in minimum deformations of the damper and of the metal bellows. Transverse forces and torques would result in much larger deformations.

A particularly desirable design will be obtained if, in accordance with the invention, the axial vibration dampers are accommodated in pot-shaped recesses of one of the parts consisting of the holder casting or of brackets mounted on the exhaust manifold means or on the cylinder head and are connected each to the other of said parts by a pin which extends through the bottom of the recess.

If the engine is provided with two exhaust manifolds, which are connected to the holder by respective metal bellows, the holder casting will be formed with two passages, which converge from the two metal bellows and are connected to a double-flow exhaust gas turbine. In that case any influence of the separate gas streams on each other will be inhibited and nevertheless the gas inlet openings of the turbine may be close to each other, as is required for the turbine.

DETAILED DESCRIPTION OF THE PREFERRED EMBODIMENT

Figure 1:
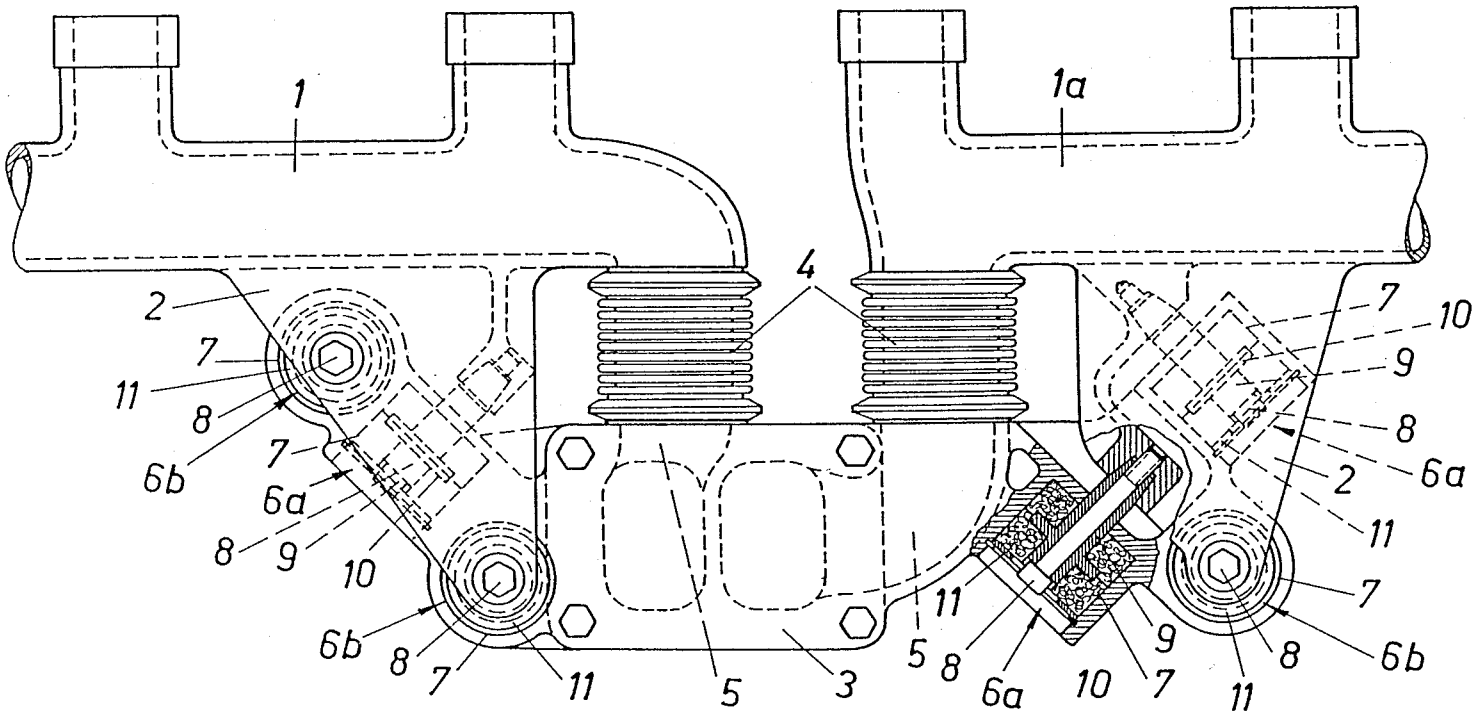
FIG. 1 is a top plan view showing those parts of an assembly for mounting the exhaust system of an internal combustion engine which are required for an understanding of the invention.
Figure 2:
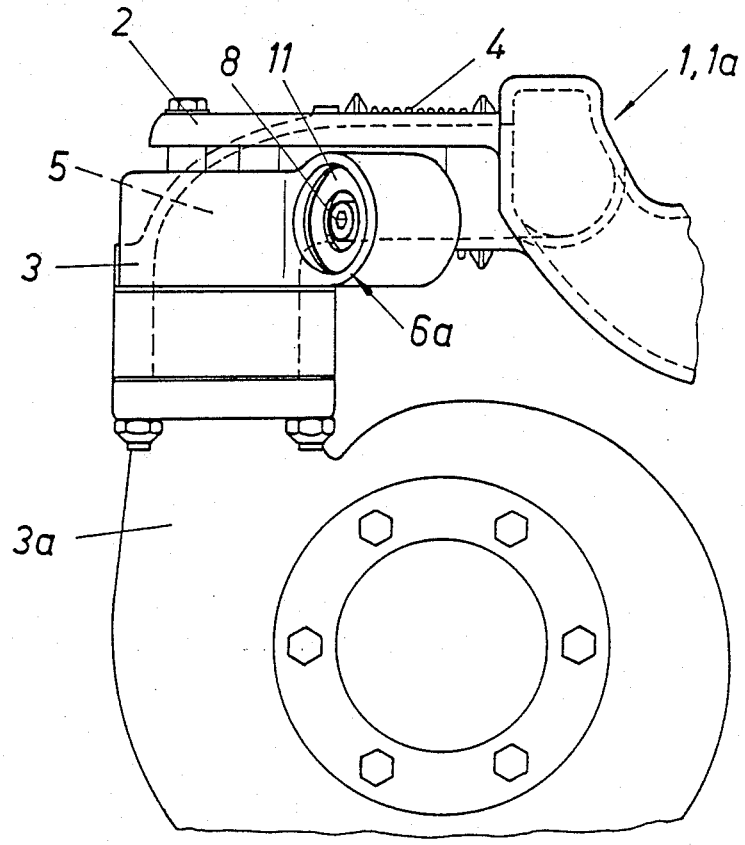
FIG. 2 is a side elevation corresponding to FIG. 1.

An illustrative embodiment of the invention will now be described more in detail with reference to the drawing.

Brackets 2 are integrally cast with two exhaust manifolds 1 and 1*a* of an internal combustion engine. A holder 3 is connected to said brackets and a double-flow exhaust gas turbine 3*a* is carried by the holder 3. The exhaust manifolds 1, 1*a* are connected to the holder 3 by two metal bellows 4, which communicate with passages 5, which are formed in the holder 3 and converge toward the turbine 3*a*. The holder 3 is connected to the brackets 2 by means which will ensure that the metal bellows will not suffer excessively large deformations. This is ensured by the provision of six axial vibration dampers 6, 6*b*. The three axial vibration dampers are parallel to each other and normal to that plane and intersect said plane. Alternatively, the axes of the three axial vibration dampers 6*b* might constitute of tripod having an apex which is spaced from said plate. Only two of the three axial vibration dampers 6*a* have parallel axes.

The axial vibration dampers 6*a*, 6*b* are accommodated in pot-shaped recesses 7 formed in the holer 3 on the side that is remote from the bellows 4 and are connected by rods 8 to lugs which are cast integrally with the bracket 2. Each pin 8 is surrounded by a sleeve 9, which has a collar 10 that is disposed within the recess 7. Vibration-damping pads made of steel wire mesh are compressed between the collar 10 and the bottom of the recess 7, on the one hand, and an annular disc 11, which is held in position by a retaining ring, on the other hand. It will be understood that said pads must have an adequate thermal stability and strength.

It will be possible, of course to provide the brackets 2 not as parts which are integrally cast with the exhaust manifolds 1, 1*a* but to secure them to the cylinder block at a suitable location.

I claim:

1. In a mounting assembly for mounting an exhaust system on an exhaust gas source structure of an internal combustion engine and for connecting inlet means of said exhaust system to exhaust gas outlet means of said source structure, comprising a holder, which is adapated to carry said exhaust system and has passages which are adapted to be connected to said inlet means, metal bellows means, which are connected to said passages and adapted to be connected to said exhaust gas outlet means, and a plurality of axial vibration dampers, which are connected to said holder and adapted to mechanically connect said holder to said source structure in operating positions in which the axes of said dampers lie in a plane, the improvement residing in that said plurality of axial vibration dampers consist of three dampers, not more than two of which have axes which are adapted to be parallel to each other in said operating positions, and three additional axial vibration dampers are connected to said holder and adapted to mechanically connect said holder to said source structure in operating positions in which the axes of said additional dampers are parallel to each other and intersect said plane.

2. The mounting assembly set forth in claim 1, wherein said holder is formed with six pot shaped recesses on a side that is remote from said bellows, said dampers extend into respective ones of said recesses and six rods are connected to respective ones of said dampers and extend through said holder and are adapted to be connected to said source structure.

3. The mounting assembly set forth in claim 1, wherein said exhaust system comprises a double-flow exhaust gas turbine on said exhaust gas source structure comprising two exhaust manifolds, wherein said metal bellows means comprise two metal bellows, said holder consists of a casting having two of said passages, which are adapted to be connected to said turbine, said metal bellows means comprise two metal bellows connected to respective ones of said passages and adapted to be connected to respective ones of said manifolds, and said passages converge from said bellows.

4. The mounting assembly set forth in claim 1, wherein said exhaust system comprising an exhaust manifold means of said internal combustion engine.

5. The mounting assembly set forth in claim 1, wherein said exhaust system comprising a cylinder head means of said internal combustion engine.

6. The mounting assembly set forth in claim 1, wherein all said dampers comprise vibration-absorbing pads consisting of steel wire mesh.

7. In a mounting assembly for mounting an exhaust system on an exhaust gas source structure of an internal combustion engine and for connecting inlet means of said exhaust system to exhaust gas outlet means of said source structure, comprising a holder, which is adapted to carry said exhaust system and has passages which are adapted to be connected to said inlet means, metal bellows means, which are connected to said passages and adapted to be connected to said exhaust gas outlet means, and a plurality of axial vibration dampers, which are connected to said holder and adapted to mechanically connect said holder to said source structure in operating positions in which the axes of said dampers lie in a plane, the improvement residing in that said plurality of axial vibration dampers consist of three dampers, not more than two of which have axes which are adapted to be parallel to each other in said operating positions, and three additional axial vibration dampers are connected to said holder and adapted to mechanically connect said holder to said source strucure in operating positions in which the axes intersect said plane and constitute a tripod having an apex spaced from said plane.

8. In a combination of an exhaust gas source structure of an internal combustion engine, which source structure comprises exhaust gas outlet means and a mounting assembly for mounting an exhaust system on said source structure and for connecting inlet means of said exhaust system to said exhaust gas outlet means, wherein said mounting assembly comprises a holder, which is adpated to carry said exhaust system and has passages which are adapted to be connectd to said inlet means, metal bellows means, which are connected to said passages and connected to said exhaust gas outlet means, and a plurality of axial vibration dampers, which mechanically connect said holder to said source structure and have axes lying in a plane, the improvement residing in that said plurality of axial vibration dampers consist of three dampers, not more than two of which have axes which are parallel to each other, and three additional axial vibration dampers are provided, which mechanically connect said holder to said source structure and have axes which are parallel to each other and intersect said plane.

9. The combination set forth in claim 8, wherein said source structure carries bracket means formed with six pot-shaped recesses on a side facing said holder.

said dampers extend into respective ones of said recesses and six rods extend through said bracket means and connect respective ones of said dampers to said holder.

10. In a combination of an exhaust gas source structure of an internal combustion engine, which source structure comprises exhaust gas outlet means and a mounting assembly for mounting an exhaust system on said source structure and for connecting inlet means of said exhaust system to said exhaust gas outlet means, wherein said mounting assembly comprises:

a holder, which is adapted to carry said exhaust system and has passages which are adapted to be connected to said inlet means, metal bellows means, which are connected to said passages and to said exhaust gas outlet means, and a plurality of axial vibration dampers, which mechanically connect said holder to said source structure and have axes disposed in a plane, the improvement residing in that said plurality of axial vibration dampers consist of three dampers, not more than two of which have axes which are parallel to each other, and three additional axial vibration dampers are provided, which mechanically connect said holder to said source structure and have axes which intersect said plane and constitute a tripod having an apex spaced from said plane.

* * * * *